US007619609B2

(12) United States Patent
Fork

(10) Patent No.: US 7,619,609 B2
(45) Date of Patent: Nov. 17, 2009

(54) FLUIDIC DISPLAY APPARATUS

(75) Inventor: David Fork, Los Altos, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 624 days.

(21) Appl. No.: 11/320,269

(22) Filed: Dec. 28, 2005

(65) Prior Publication Data

US 2007/0146238 A1 Jun. 28, 2007

(51) Int. Cl.
*G09G 3/34* (2006.01)

(52) U.S. Cl. ..... 345/107; 345/60

(58) Field of Classification Search ..... 345/60–63, 345/65, 66, 107

See application file for complete search history.

(56) References Cited

U.S. PATENT DOCUMENTS

| | | | | |
|---|---|---|---|---|
| 4,757,235 | A | 7/1988 | Nunomura et al. | |
| 5,771,810 | A * | 6/1998 | Wolcott | 101/483 |
| 6,037,955 | A | 3/2000 | DeBoer et al. | |
| 6,137,553 | A | 10/2000 | Izumi et al. | |
| 6,589,673 | B1 | 7/2003 | Kido et al. | |
| 6,683,665 | B1 | 1/2004 | Matthies | |
| 6,747,777 | B1 * | 6/2004 | Sikora et al. | 359/253 |
| 6,765,562 | B2 | 7/2004 | Yamazaki et al. | |
| 6,781,667 | B2 | 8/2004 | Horiguchi et al. | |
| 6,867,540 | B2 | 3/2005 | Morley et al. | |
| 6,885,495 | B2 | 4/2005 | Liang et al. | |
| 6,897,855 | B1 | 5/2005 | Matthies et al. | |
| 7,205,962 | B2 * | 4/2007 | Cooke | 345/60 |
| 7,304,620 | B2 * | 12/2007 | Yamamoto et al. | 345/5 |
| 7,359,108 | B2 * | 4/2008 | Hayes et al. | 359/296 |
| 2003/0164295 | A1 * | 9/2003 | Sterling | 204/450 |
| 2005/0072946 | A1 * | 4/2005 | Studer et al. | 251/11 |
| 2006/0103686 | A1 * | 5/2006 | Sikora et al. | 346/140.1 |
| 2006/0197723 | A1 * | 9/2006 | Sikora et al. | 345/84 |

* cited by examiner

*Primary Examiner*—Ricardo L Osorio
(74) *Attorney, Agent, or Firm*—Jonathan A. Small

(57) ABSTRACT

A display device uses the presence or absence of a pigmented fluid in a pixel to indicate pixel state. Fluid flow to or extraction from individual pixels is controlled through manipulation of row and column fluid pressures. A pixel wall opposite a viewer may be provided with a background color contrasting the color of the pigmented fluid. When present in the pixel, the pigmented fluid obscures the colored wall of the pixel, and viewer sees the pixel as the color of the fluid (a first state). When the fluid is absent from the pixel, the viewer sees the pixel as the color of the wall of the pixel (a second state). When partially present, the fluid color and the wall color mix to provide grayscale display.

21 Claims, 7 Drawing Sheets

FLUIDIC DISPLAY APPARATUS

BACKGROUND OF THE INVENTION

1. Field of the Invention

The present invention is related to data display apparatus, and more particularly to a display apparatus which employs a pigmented fluid to distinguish between a first and second state of individual display elements.

2. Description of the Prior Art

Presently there is a distinct separation between signage and data display technology. Signage, which typically displays a static image or images which remain displayed for relatively long periods of time, is often deployed in conditions requiring a high degree of robustness and serviceability, low power consumption, and low cost. These requirements are not met by the relatively fragile and much higher cost data displays. While the video demands of data displays require rapid refresh rates and high resolution, the refresh rates for signage are generally quite long, and their resolution is generally low. And, the overall size of signage, typically measured diagonally, is often much larger than that of data displays. Technologies currently meeting the criteria for signage are limited, and include fixed image devices such as mechanical, rotating plate or column devices and backlit scrolling signs, and basic image forming devices such as highly pixelated light-bulb based signs: However, due to the lack of alternatives, data display technology has been employed on a limited basis for certain signage applications.

There are basically three categories of data display devices: direct view, projected view, and projector devices. Direct view devices display images on a surface overlaying the pixel control mechanisms. The most common direct view devices include CRTs up to about 45 in. diagonally, and light emitting diodes (LEDs), liquid crystal displays (LCDs), and plasma field displays up to about 60 in. diagonally. Projected view devices often employ direct-view components, but enlarge the image provided by the direct-view components by reflecting the image using a series of mirrors onto a large display surface that is generally integrated with the direct view component. Most "big screen" televisions above 60 in. diagonally use projected view technology. Projector displays project an image onto an arbitrary surface. Common projected systems used CRT-based, LCD-based, and DLP (reflective micro mirror chip)-based image forming components.

Each of the aforementioned display technologies have limitations when employed as signage. For direct view devices, the pixels produced are generally quite small. Thus, a large direct view display has a large number of pixels. The cost of a direct view display above 60 inches diagonally increases approximately as the cube of diagonal screen size. And with tens of thousands of individual pixels to address, these displays are complex, difficult to service, and require significant amounts of power.

To address this, manufacturers have recently begun tiling together elements of lower-cost, smaller direct view display devices. For example, U.S. Pat. No. 6,897,855, which is incorporated herein by reference, teaches manufacturing a large-area display by abutting a number of individual LED tiles together. However, such tiled displays are still burdened by high cost, complexity of assembling and addressing, reliability, serviceability, high power consumption, etc. Furthermore, these devices are relatively fragile and not designed for exposure to inclement or other harsh conditions.

For projected view and projector displays, the quality and visibility of projected images are dependent on ambient light conditions, the surface upon which the images are projected, the brightness of the projector, and the stability of the location of the projector and surface upon which the image is displayed. For projector displays there are the added concerns about freedom from people, objects, etc. passing through the projected image path. Furthermore, there is a reciprocal relationship between the brightness of an image source, such the that providing the image in a projected view display or projector, and the lifespan of the image generating hardware. For example, the brighter the projector the shorter the life of the bulb and other projector components. For most large-area display applications, especially signage and outdoor displays, brightness, and hence contrast, is a critical measure of quality, so that from a lifespan perspective, projected view and projector displays are not optimal.

Thus, the use of data displays for signage and the like is at best a compromise, and at worst an inappropriate use of the technology. Accordingly, there is an unmet need for a low cost, reliable, serviceable, robust, large-area, variable display data device appropriate for use as signage and the like.

SUMMARY OF THE INVENTION

The present invention is a novel large-area display apparatus addressing several design targets, including:

- Large pixel size
- Passively addressed
- Use of economical, existing materials and process technology
- Use of economical, existing fabrication technology
- High Contrast Ratio
- Refresh times less than 5 minutes
- High reliability
- Robust for use in outdoor and inclement conditions
- Ease of serviceability
- Low power consumption As used herein, the term large-area display is intended to imply a display device larger than commercially available televisions, computer monitors, and the like. The term variable data display device is intended to imply a device capable of displaying an arbitrary image, either monochrome, grayscale or full color, as typically provided by an image processor to which the display is connected. For the purposes hereof, we use the terms large-area variable display data device and large-area display device interchangeably.

The display according to the present invention comprises an array of relatively large, thin pixels having at least two possible states. A first state is indicated by the presence of a pigmented fluid, and a second state is indicated by the absence of the pigmented fluid. By pigmented fluid, we mean here fluids of a type having an apparent color. That color may be imparted by distributed particulates, such as a suspension, or the molecules forming the fluid itself, such as a dye. The fluid itself may be virtually any flowable liquid or the like, such as water or oil. Grayscale may be achieved by selectively controlling the amount of fluid present in the pixel.

The array is operated by controllably moving fluid into and out of the pixels. According to one aspect of the invention, a fluid control (column) manifold uses an optically transparent working fluid while a row fluid manifold uses a pigmented fluid. The fluid pressure in both columns and rows may be individually adjusted, on either side of a transparent membrane. Control of these fluid pressures allows for moving pigmented fluid into and out of a fluid display region disposed under the transparent membrane. Valves associated with each pixel allow one row to be updated while other rows hold their information (stored state). Peripheral valves connected to the rows and columns serve to address and update information throughout the display.

Individual pixels comprise a body in which are formed two row channels. A passive one-way valve is provided at each channel, so that one channel becomes an inlet to and the other becomes an outlet from the pixel for the pigmented fluid. The passive valves respond to pressures imparted to the fluid in the inlet and outlet channels. A cavity is formed over the channels by a pixel grid and a top plate. The transparent membrane is disposed in the cavity above the row channels, and forms a fluid receiving region into which the pigmented fluid may be selectively introduced. The fluid control (column) channel is formed in the top plate, extending generally perpendicular to the inlet and outlet channels.

A fluid manifold valve is also disclosed. The valve includes a substrate, a valve body in which are formed primary and secondary fluid channels, a magnetically-actuated flow control plate, and actuator coils (elastomeric, electrostatic or electro-kinetic pilot valves may also be employed). The flow control plate is normally biased such that the primary fluid channel is open and the secondary channel is closed. When energized, the actuator coil attracts the flow control plate, closing the primary fluid channel and opening the secondary fluid channel.

The above is a summary of a number of the unique aspects, features, and advantages of the present invention. However, this summary is not exhaustive. Thus, these and other aspects, features, and advantages of the present invention will become more apparent from the following detailed description and the appended drawings, when considered in light of the claims provided herein.

BRIEF DESCRIPTION OF THE DRAWINGS

In the drawings appended hereto like reference numerals denote like elements between the various drawings. While illustrative, the drawings are not drawn to scale. In the drawings.

DETAILED DESCRIPTION OF THE INVENTION

In its broadest sense, the present invention is a display device, ideally suited for signage and similar applications, in which the state of an individual display element, or pixel, is a function of the presence of a fluid at that pixel. More specifically, it is possible to control fluid flow to an individual pixel through manipulation of row and control (column) pressures such that a first colored fluid may be introduced into the pixel to indicate to a viewer a first display state, then a second fluid may be introduced into the pixel, displacing the first fluid, to thereby indicate to a viewer a second display state. A pixel wall opposite a viewer may be provided with a background color and the row and control (column) pressures may be manipulated such that a first colored fluid which is capable of obscuring the pixel wall background color is introduced into the pixel to indicate the first display state. The first color fluid may be displaced by the introduction of a transparent fluid such that the pixel wall background color appears to indicate to a viewer a second display state. Alternatively, the second fluid may be pigmented to contrast with the first fluid such that when the second fluid displaces the first fluid the pixel appears as the color of the second fluid. This basic functionality may be implemented in myriad embodiments, a number of which are described below.

Figure 1:
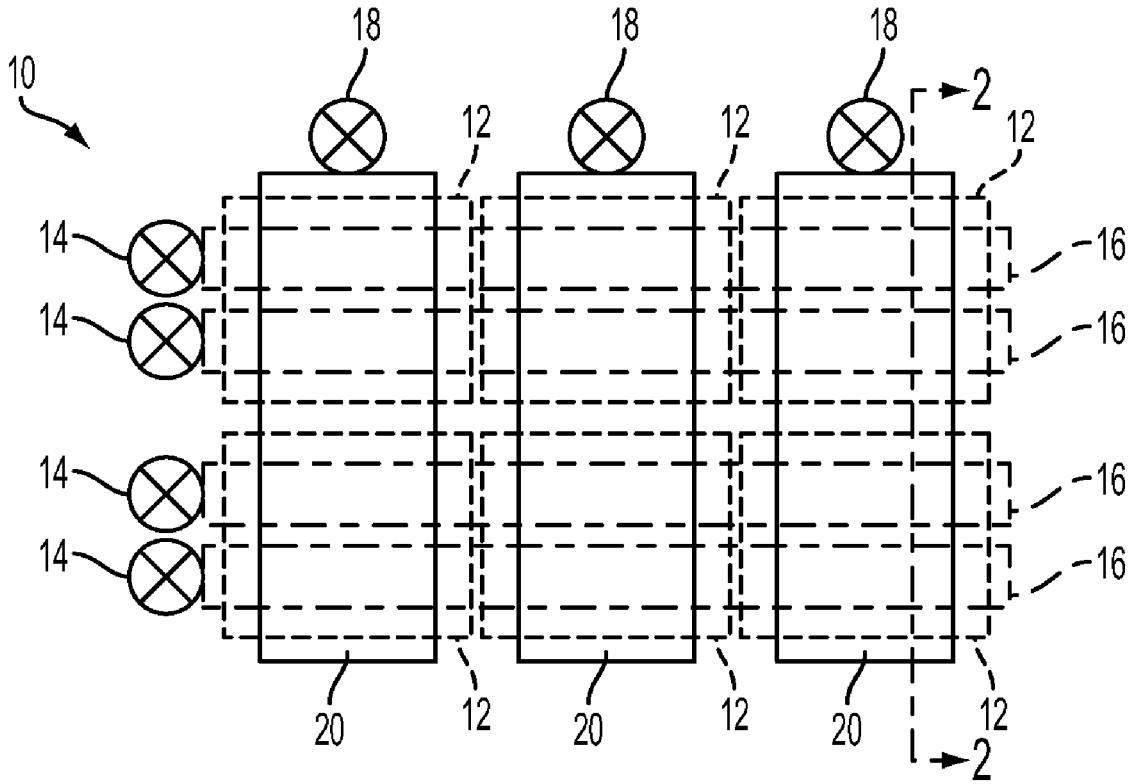
FIG. 1 is a plan view of a portion of a fluidic display device according to one aspect of the present invention.

FIG. 1 is an illustration of a first embodiment 10 of the fluidic display device of the present invention. Shown in FIG. 1 is an array of pixels 12 which are provided with mechanisms for selectively introducing fluid therein, such as individual row valves 14 in communication with row channels 16, and individual control (column) valves 18 in communication with control (column) channels 20. While six pixels 12 and their associated valves and channels are shown in FIG. 1, it will be understood that the number of such pixels is function of the design and application of the actual display device, and may range from tens to thousands of pixels or more. Furthermore, while the drawings herein are not to scale, the pixels shown in FIG. 1 are significantly magnified for ease of understanding. The actual size of such pixels is a function of the design and application of the actual display device, and may in some applications be on the order of square millimeters.

Figure 2:
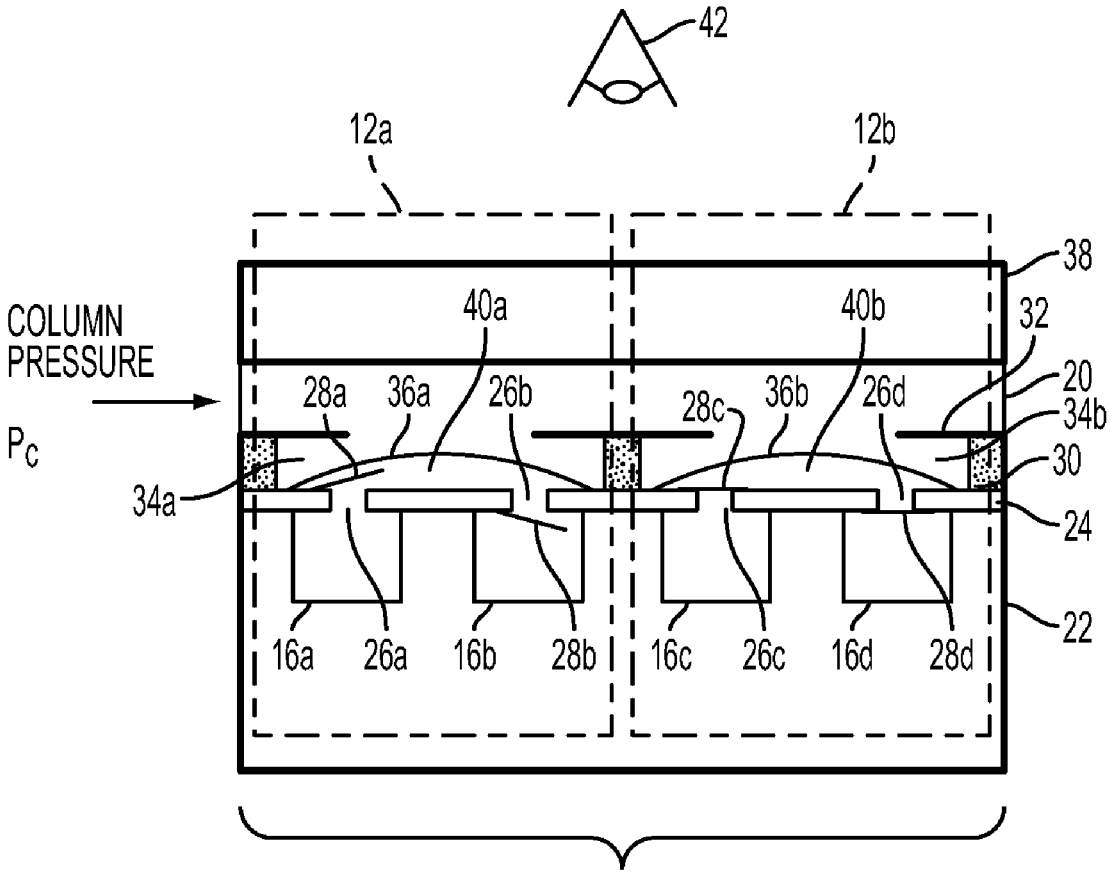
FIG. 2 is a cut-away view of a portion of a fluidic display device according to one aspect of the present invention.

FIG. 2 is a cut-away view of a portion of fluidic display device 10, detailing two exemplary pixels 12*a* and 12*b*. Structurally, pixel 12*a* includes two row channels, inlet row channel 16*a* and outlet row channel 16*b*, and pixel 12*b* includes two row channels, inlet row channel 16*c* and outlet row channel 16*d*. All row channels are shown formed in a common substrate 22, but may be formed in separate substrates without departing from the scope of the present invention. A valve plate 24 is positioned over substrate 22, providing fluid ports 26*a*, 26*b* in pixel 12*a*, and fluid ports 26*c*, 26*d* in pixel 12*b*. Attached to valve plate 24 and proximate fluid ports 26*a*, 26*b*, 26*c*, 26*d* are passive valves 28*a*, 28*b*, 28*c*, 28*d*, respectively. A pixel grid 30 provides support for aperture plate 32, creating a cavity 34*a* in first pixel 12*a* and a cavity 34*b* in second pixel 12*b*. Within each cavity 34*a*, 34*b*is disposed a transparent membrane 36*a*, 36*b*, respectively. A transparent top plate 38 is disposed above aperture plate 32 so as to define control (column) channel 20, which is in communication with cavities 34*a*, 34*b*.

Row channels 16*a*, 16*b*, 16*c*, and 16*d* are each filled with a pigmented fluid (not shown). The particular fluid and pigment used depend upon the application of the fluid display device, and are chosen with attributes such as viscosity, boiling and freezing points, pigment suspendability, corrosivity, pigment hue and contrast, etc., in mind. As previously mentioned, aqueous inks and pigmented oils are examples of such pigmented fluids. Various materials may be added to the fluids to obtain desired characteristics, such as raising boiling points, lowering freezing points, reducing cavitation, etc. The pigmented fluid may circulate through the row channels, being permitted to enter into a fluid display region 40*a* between valve plate 24 and transparent membrane 36*a*, and fluid display region 40*b* between valve plate 24 and transparent membrane 36*b*, as described further below.

Figure 3A:
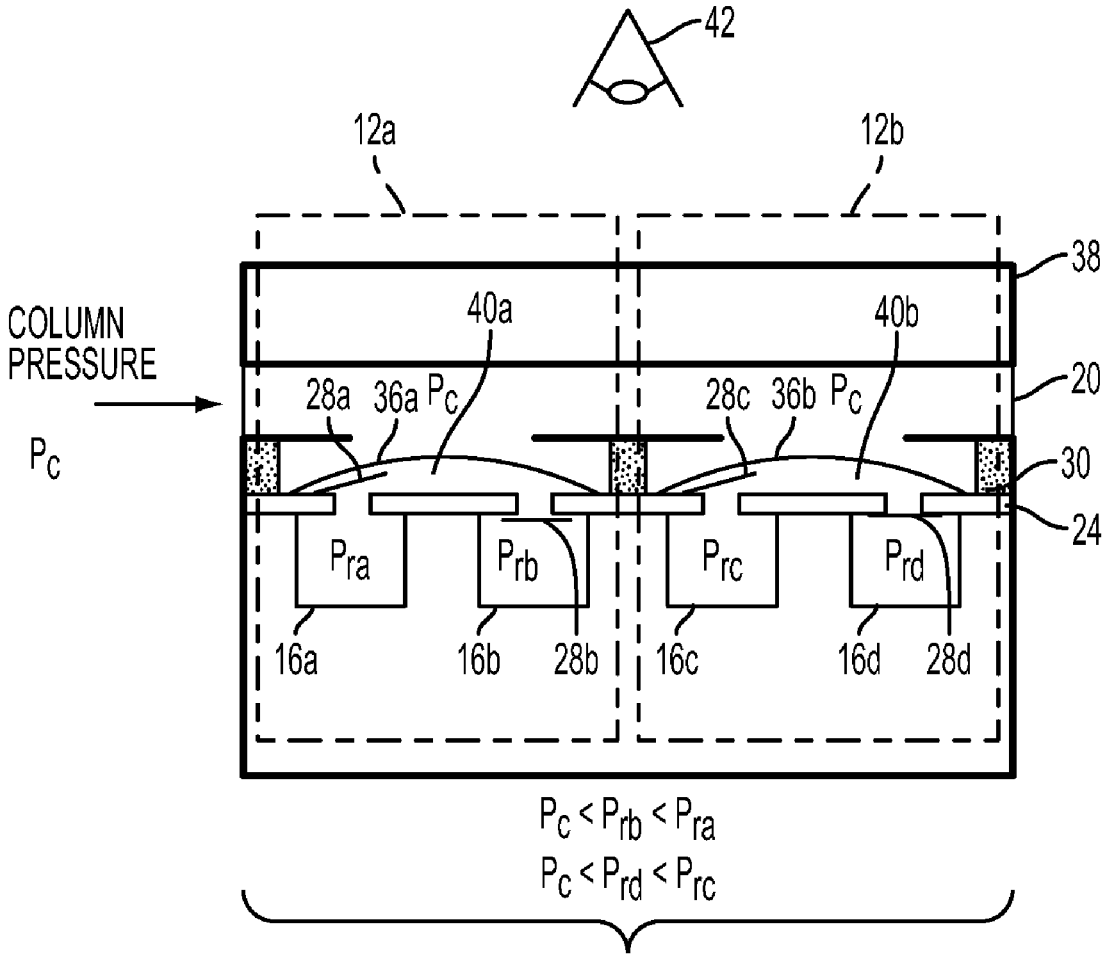
FIGS. 3A, 3B, and 3C are cut-away views of a portion of a fluidic display device, detailing various states of passive valves and the pressures required to obtain those states, according to one aspect of the present invention.

Independent addressing of pixels 12*a*, 12*b* in order to select between a first and second display state for each pixel may proceed as follows. With reference to FIG. 3A, the pigmented fluid in row channel 16*a* is maintained at a first pressure, say $P_{ra}$, the pigmented fluid in row channel 16*b* is maintained at a second pressure, say $P_{rb}$, the pigmented fluid in row channel 16*c* is maintained at a third pressure, say $P_{rc}$, and the pigmented fluid in row channel 16*d* is maintained at a fourth pressure, say $P_{rd}$. In addition, a transparent fluid (not shown) may be provided in control (column) channel 20 which is maintained at a fifth pressure, say $P_c$. The transparent fluid in control (column) channel 20 is preferably an index matched fluid that produces little optical scattering at the boundary of the fluid and the channel. Each of $P_{ra}$, $P_{rb}$, $P_{rc}$, $P_{rd}$, and $P_c$ are independently controllable via mechanisms described further below.

In a first combination of the various pressures shown in FIG. 3A, the pigmented fluid is introduced into fluid display regions 40*a* and 40*b*. To accomplish this, the pressure $P_{ra}$ exceeds the pressures $P_{rb}$ and $P_c$ such that passive valve 28*a* is open and passive valve 28*b* is closed. That is, $P_c<P_{rb}<P_{ra}$. The pigmented fluid is thereby permitted to flow from row channel 16*a* into fluid display region 40*a*. Likewise, the pressure $P_{rc}$ exceeds the pressures $P_{rd}$ and $P_c$ such that passive valve 28*c* is open and passive valve 28*d* is closed. So that $P_c<P_{rd}<P_{rc}$. The pigmented fluid is thereby also permitted to flow from row channel 16*c* into fluid display region 40*b*. The pigmented fluid is thereby presented to a viewer 42 for viewing through membranes 36*a*, 36*b* and transparent top plate 38. Pixels 12*a* and 12*b* will thus appear to be the color of the pigmented fluid.

Figure 3B:
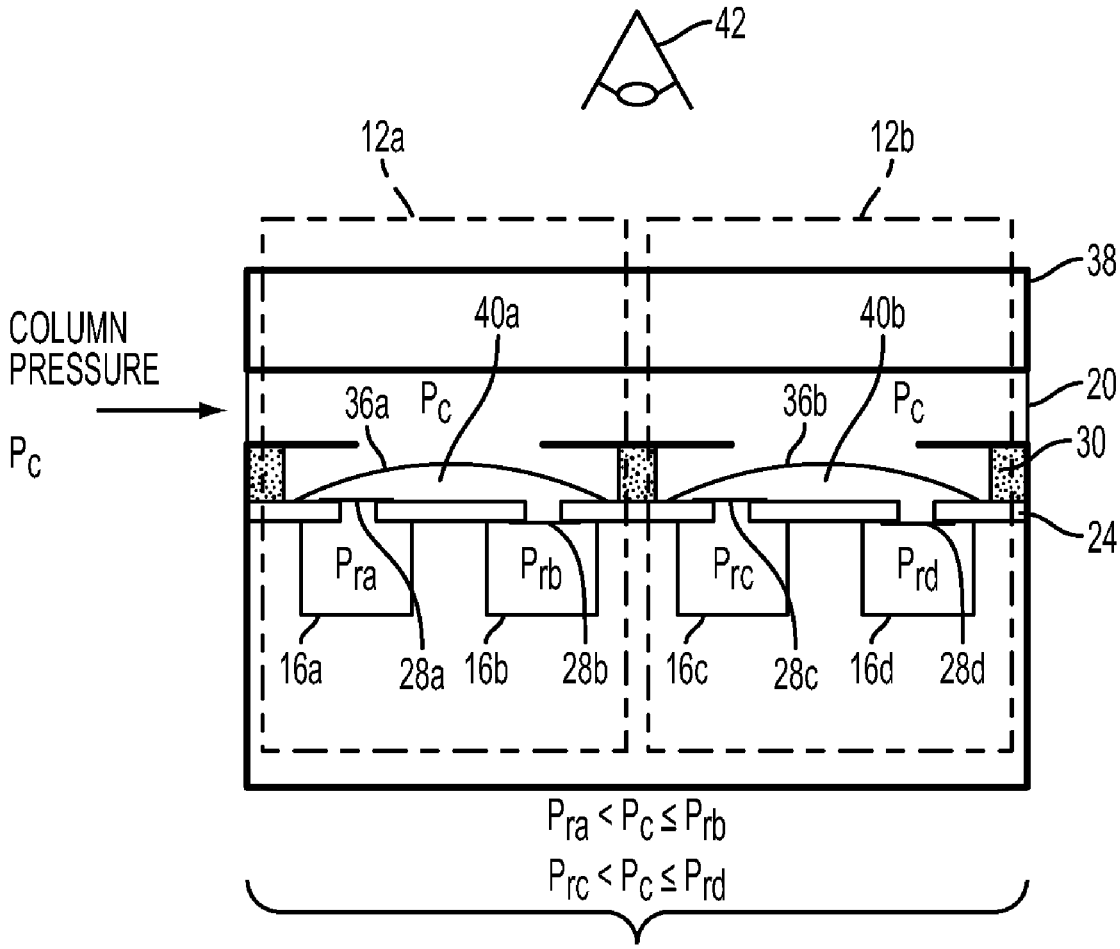
Figure 3C:
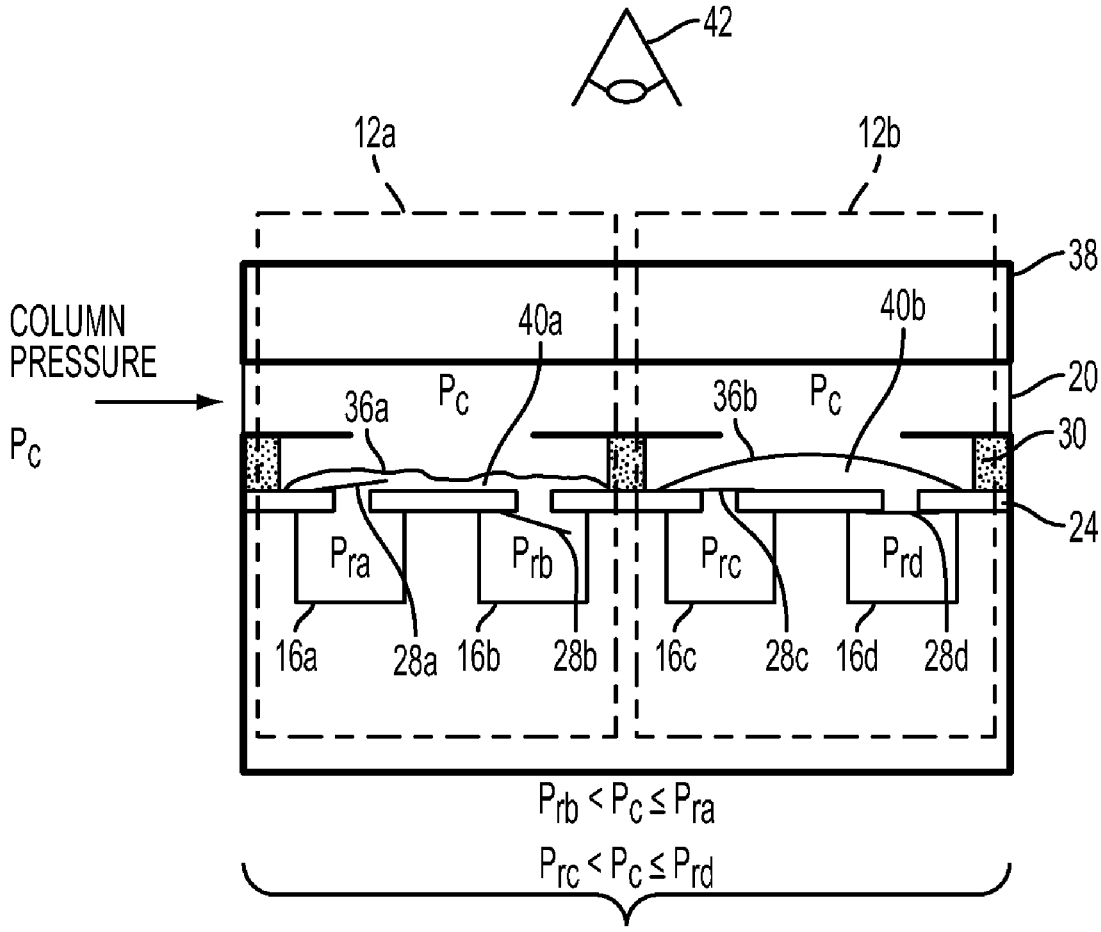

According to one aspect of the present invention, it is possible to passively maintain the state of the pixels for relatively long periods of time. That is, once established, the state of a pixel may remain effectively unchanged until the pixel is again addressed. This facilitates use of a relatively slow and low cost addressing mechanism, namely changing pressures in row and control (column) channels. In order to maintain state, the passive valves 28*a* through 28*d* should be closed, as shown in FIG. 3B. To accomplish this, the control (column) channel pressure $P_c$ is raised, the row channel pressures $P_{ra}$ and $P_{rc}$ are lowered, and the row channel pressures $P_{rb}$ and $P_{rd}$ are not changed. That is, $P_{ra}<P_c\leqq P_{rb}$ and $P_{rc}<P_c\leqq P_{rd}$.

In order to change the state of pixel 12*a* without changing the state of pixel 12*b*, the pressure $P_{ra}$ is raised, while $P_{rb}$ is lowered. The pressure $P_c$ remains unchanged from the hold state. Thus, $P_{rb}<P_c\leqq P_{ra}$. This causes passive valve 28*a* to maintain its closed position, and causes passive valve 28*b* to open. In this position, the pressure $P_c$ against membrane 36*a* forces the pigmented fluid out of fluid display region 40*a* through valve 28*b*. Viewer 42 then views pixel 12*a* to be the color of the top surface of valve plate 24, which may be selected to be a contrasting color to that of the pigmented fluid (the fluid being white, the top surface of valve plate 24 being black, as one of a great many possible combinations). However, with regard to pixel 12*b*, its state is maintained since $P_{rc}$, $P_{rd}$ and $P_c$ are unchanged. As the pressure, Pc, in each control (column) channel is independently controllable, each pixel may be addressed independently through a combination of row and control (column) pressures.

While top plate 38, the control (column) fluid, and the material from which membranes 36*a*, 36*b* are all chosen to be transparent, a combination of the materials forming elements below membranes 36*a*, 36*b* determines the background color when the pixels are empty of fluid. These elements include the inlet channels, outlet channels, and valve plate. Other materials can be introduced to enhance the color or contrast of the pigmented fluid, such as adhesives or fluorescent materials. The materials in contact with the pigmented fluid are chosen so that they are not stained by the fluid, and are readily expelled from the fluid display regions 40*a*, 40*b* without leaving residue therein. A structural coating of DuPont Teflon® (FEP fluorocarbon film) may be applied over surfaces in contact with the pigmented fluid for these purposes.

Figure 4:
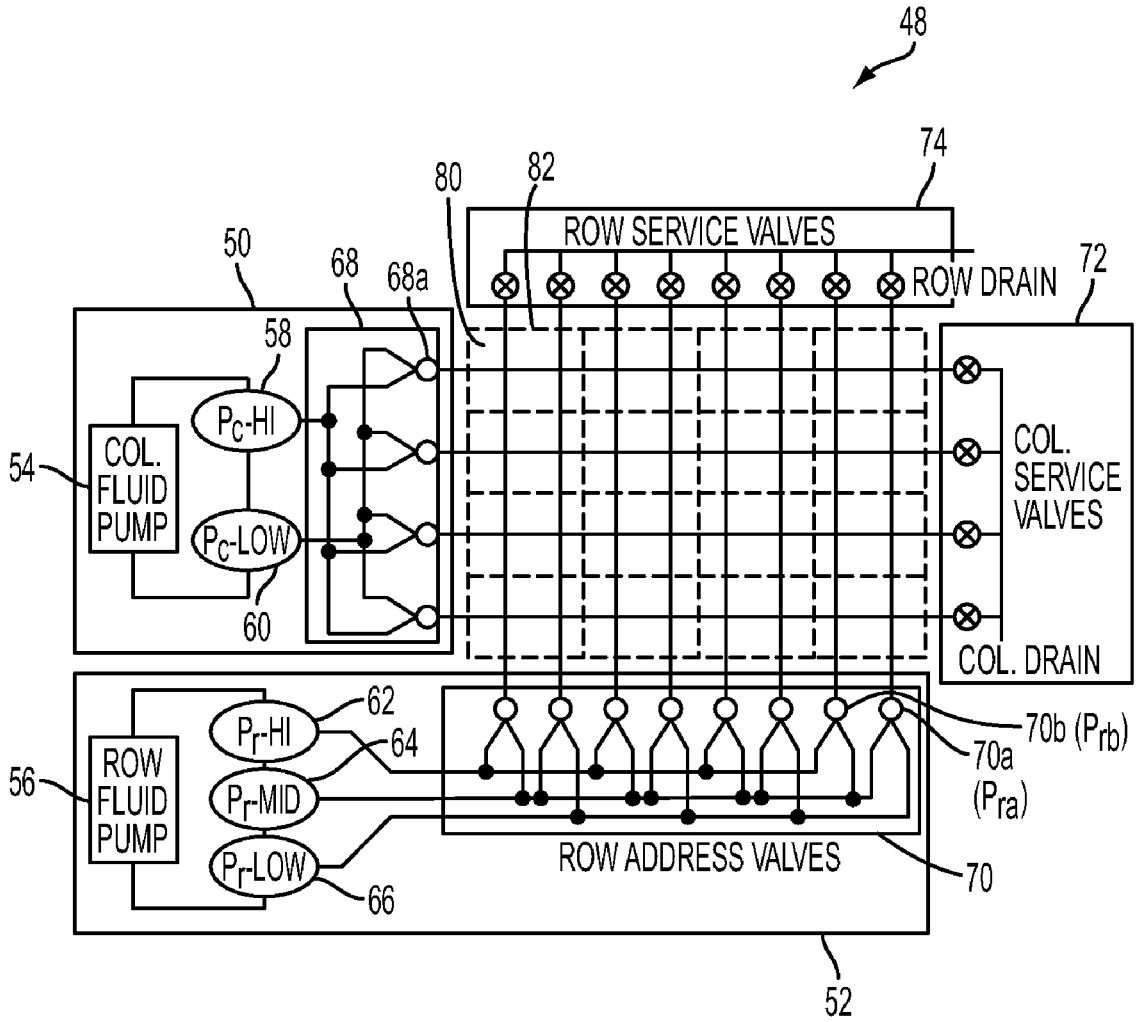
FIG. 4 is a schematic illustration of an array and fluid control and distribution system and components for passive independent addressing according to one aspect of the present invention.

A schematic of an array and fluid control and distribution system 48 is shown in FIG. 4, illustrating a 4×4 array of pixels (rotated 90 degrees from is display orientation for illustrative purposes) and components for passively independently addressing each pixel. Each pixel in the array of FIG. 4 includes the row and control (column) channels, valve plate, fluid ports, passive valves, pixel grid, aperture plate, cavity, transparent membrane, and the fluid display region identified and operating as described with regard to FIG. 2A and 2B. Furthermore, two fluid manifolds 50, 52 consisting of pumps 54, 56 pressure regulators 58, 60, 62, 64, 66, and valve arrays 68, 70 drive the display from its periphery. Valve arrays 72, 74 terminate each row channel and each control (column) channel. Each of the valves in valve arrays 68-74 can be simple two-state valves connected to pressure regulators 58-66 in order to be provide row and control (column) channels with selected pressures to enable independent passive pixel addressing. Optional service valves and fill and drain ports 72, 74 may be situated on the periphery of the array to facilitate filling or draining fluid in the array, either during construction or during service.

In operation, the state of a pixel such as pixel 80 may be changed (i.e., the pixel may be written to), while the state of all other pixels in the array are maintained. For the purposes of explanation, assume that pixel 80 currently has pigmented fluid stored therein (i.e., that the pixel is currently "on") and its state is being maintained. In this state, row pressure $P_{ra}$ is low, row pressure $P_{rb}$ is high, and control (column) pressure $P_c$ is high. This is accomplished by opening valve 70*a* to mid pressure regulator 64, opening valve 70*b* to high pressure regulator 62, and opening valve 68*a* to high pressure regulator 58. In order to change the pixel state (i.e., turn the pixel "off") without affecting the state of the remaining pixels in the array, valve 70*b* is switched so as to be open to low pressure regulator.

Writing data to the display is achieved by maintaining the state of the pixels in all rows except one fixed by closing off the passive valves to all of the pixels in those rows. The remaining row can then be written with data supplied by the column drivers. The pressures needed to achieve this operation are indicated in the FIG. 4. Each inlet row can be supplied with a medium (write) or a low (hold) pressure. Each outlet row can be supplied with a medium (write) or a high (hold) pressure. Data is written to a pixel in the active row by adjusting the times that the corresponding column is held in one of at least two pressure states. In the high state, the column expels colored fluid into the outlet row from its corresponding pixel. In the low state, the column receives transparent fluid from the pixel as the pixel fills with colored fluid from its inlet row. As long as the write pressures developed by the columns are bounded by the hold pressures that close off the inactive rows, data is retained, and passive addressing is achieved.

For example, the data in row 82 can be changed by setting the row address valves feeding that row to the medium (write) pressure. All other rows remain unaddressed by maintaining their inlet valves at a low row pressure and their outlet valves at a high row pressure. Data can be written simultaneously to all of the pixels in row 82 by controlling the timing of the valves connected to the columns of the display. Only the contents of row 82 is affected, because the valves in all other rows are shut off. For example, one could write all of the pixels in row 82 black (assuming use of a black pigmented fluid) by setting all of the column valves to the low column pressure, which would cause the pixel chambers to fill with the pigmented fluid. Alternately all of the pixels could be written white (assuming a white pixel cell wall or valve plate) by setting all of the column valves to the high column pressure. This causes any pigmented fluid in the pixel chambers to be expelled. To write black in selected pixels only, a low column pressure is applied to only those pixels, while all other pixels are maintained at a low pressure.

Complete filling or emptying of individual pixel chambers will produce a binary image on the display. Grayscale display is possible by controlling the amount of pigmented fluid in the chamber. This can be achieved by adjusting the amount of time that the column valves are in their respective high and low states during a write cycle. As the amount of fluid in the pixel chamber depends both on the flow in and out of the pixel as well as the pixel's initial contents, the display controller may drive the display differentially by moving each pixel from its initial state to its new desired state. Alternatively, the display controller can refresh each row of data to for example, all empty pixels, and then proceed to write the desired state by switching the column valves for the appropriate amounts of time.

Optionally, the display can operate in two modes, a writing mode in which pressures for writing and holding are supplied to the array, and a storage mode in which all pressures are reduced, for example, to minimize stresses on the array components. The storage mode may be implemented by switching in different pressures into the pressure supply lines via auxiliary pressure regulators, or having variable pressure regulators.

Display speed is determined primarily by the time it takes fluid to move along rows between the pixels and the periphery. Small delays are attributable to the time it takes to raise and lower the pressures in row and control (column) channels and the impedance due to the size of the fluid ports. The worst-case condition is where all of the pixels in a given row must invert their state, because this produces a flow equal to the sum of pixel volumes in that row. A simple fluid flow model based on circular duct flow (an approximation only) was used to compute the time it takes fluid to flow out to the edge of the display under worst-case conditions. Table 1, below, was used to compute the frame period of the display and other properties.

It is assumed that the display has 6 mm×6 mm pixels, and is a VGA (640×480) resolution device. Pixels are assumed to be about 25 microns high. Each pixel has a volume of about 0.9 $mm^3$. The volume of pigmented fluid is dominated by the volume of the row channels (i.e., a majority of the pigmented fluid is stored in the channels). The total volume of ink is about 15 liters, even though only about 300 ml is needed to fill the pixels (i.e., a majority of the pigmented fluid is stored in the channels). While a reservoir (not shown) may be provided for excess fluid, the relative change in volume of the ink stored in the reservoir and in the channels will be small since the majority of the fluid resides in the channels for the various display states.

TABLE 1

| Display Model | |
|---|---|
| Input Parameters<br>Dimensions | Computed Properties<br>Computed Dimensions |
| Rows 480<br>Columns 640<br>Pixel size 6 mm × 6 mm<br>Pixel height 25 microns<br>Row channel width 2 mm | <br><br>Pixel volume 0.90 $mm^3$<br>Column length 2.88 meters<br>Ink channel radius 1.27E−03 meters |

TABLE 1-continued

| Display Model | |
|---|---|
| Row channel depth 2 mm<br>Column channel width 1 mm<br>Column channel depth 1 mm<br>Spacer width 150 um | Max row ink volume 5.76E−07 $m^3$<br>Column channel radius 3.18E−04 meters<br>Max col. fluid volume 9E−10 $m^3$<br>Aperture ratio 95% |
| Fluid Properties | Bond Strength Requirements |
| Ink Viscosity 0.001 Pa-sec<br>Column fluid viscosity 0.001 Pa-sec | Max column outward pressure 8 PSI<br>Min spacer bond strength 154.0 PSI |
| Pressure Settings | Display Dynamics |
| $P_r$-high -outlet shut pressure 10 PSI<br>$P_c$-high - column write white 8 PSI<br>$P_c$-low - column write black - 8 PSI<br>$P_r$-low - inlet shut pressure - 10 PSI<br>$P_r$-mid - row enable pressure 0 PSI | Row pressure drop 55236.47 Pa<br>Row pressure gradient 14384.50 Pa/meter<br>Row flow rate 1.48455E−05 $m^3$/sec<br>Row invert time 0.038799613 sec<br>Display frame time 18.62381446 sec |

The pressures assumed for the device ranged from −10 to +10 PSI. It was assumed that 2 PSI across the passive valves would be sufficient to hold them closed. The time needed to invert the color of a single row is about 40 msec, and the frame time of the entire array is less than 20 seconds. A viscosity of the pigmented fluid comparable to water was assumed. One notable feature of this display is that as the pixels and the array size become larger, the display effectively becomes faster.

Gravity will cause the fluid pressure to be greater at the bottom of the display than at the top. For water (i.e. a specific gravity of 1), this amounts to about 0.5 PSI/foot. A 10 foot tall display will have a 5 PSI variation in the control (column) from top to bottom. Because the pixel switching depends on pressure differences between the rows and columns, the switching speed does not vary across the display, because the pressure differences do not vary with location, provided that the clear and opaque fluids have similar specific gravities.

Addressing with pressure instead of voltage leads to the complication that too much pressure could rupture the display. Referring again to FIG. 2, the weakest part of the display resides at the interfaces between assembled layers of the display, such as between the pixel grid 30 and the top plate 38. The spacer width on the pixel grid of 150 microns was chosen such that the aperture ratio of the display is 95%. The spacer width cannot be made arbitrarily small since the outward pressure of the pressurized columns exerts a concentrated force on the spacers. At the 8 PSI pressure assumed, the spacer would need a minimum bond strength of about 150 PSI. This is about 1/10 the tensile strength of Teflon. Proper Teflon thermal bonds can approach the strength of the underlying material. However, spacer width, channel pressures, bonding materials, etc., must be considered when designing a functioning array.

An alternative to the addressing techniques discussed above contemplates a more delicate array construction. In those applications where large top plate pressure cannot be tolerated, when the state of a pixel must be established, any pigmented fluid in the pixel is initially purged with a negative pressure. Each pixel is then individually written to in order to produce an image by enabling rows one at a time and sending only non-positive pressures to the control (column) channels.

One aspect of the present invention is the use of existing materials and technologies for fabrication and operation of a large-area display. Most of the components of the array described above may readily be fabricated using established machining and laser cutting techniques and readily available materials. None of the tolerances contemplated require sophisticated fabrication techniques or apparatus. Any coatings to be applied or use of coated material, such as Teflon, would follow tried and true procedures, such as thermoforming, heat sealing, and welding. Consistent with the embodiment described above, row channels are formed in substrate 22 and control (column) channels formed in the transparent top plate 38. This can be achieved for example by laser cutting. Valve plate 24, passive valve membranes 28*a* through 28*d*, and transparent membranes 36*a*, 36*b* are die cut and bonded together into a subassembly. This subassembly is bonded to substrate 22. Pixel grid 30 and aperture plate 32 are then sandwiched between the subassembly and top plate 38, and this unit is bonded together.

One of the many advantages provided by the use of existing materials and technologies for fabrication and operation of a large-area display is reduced cost. Currently, the cost of production for a large-area LED approaches $8,000 per square foot. Complete manufacturing costs for a large-area fluidic display device of the type described above is on the order of $400/sq. ft. This cost calculation contemplates the use of commercially available, discrete valves, which may constitute as much as 90% or more of the display cost. Batch fabricated peripheral valves may reduce costs to as low as $100/sq. ft. or less.

Figure 5:
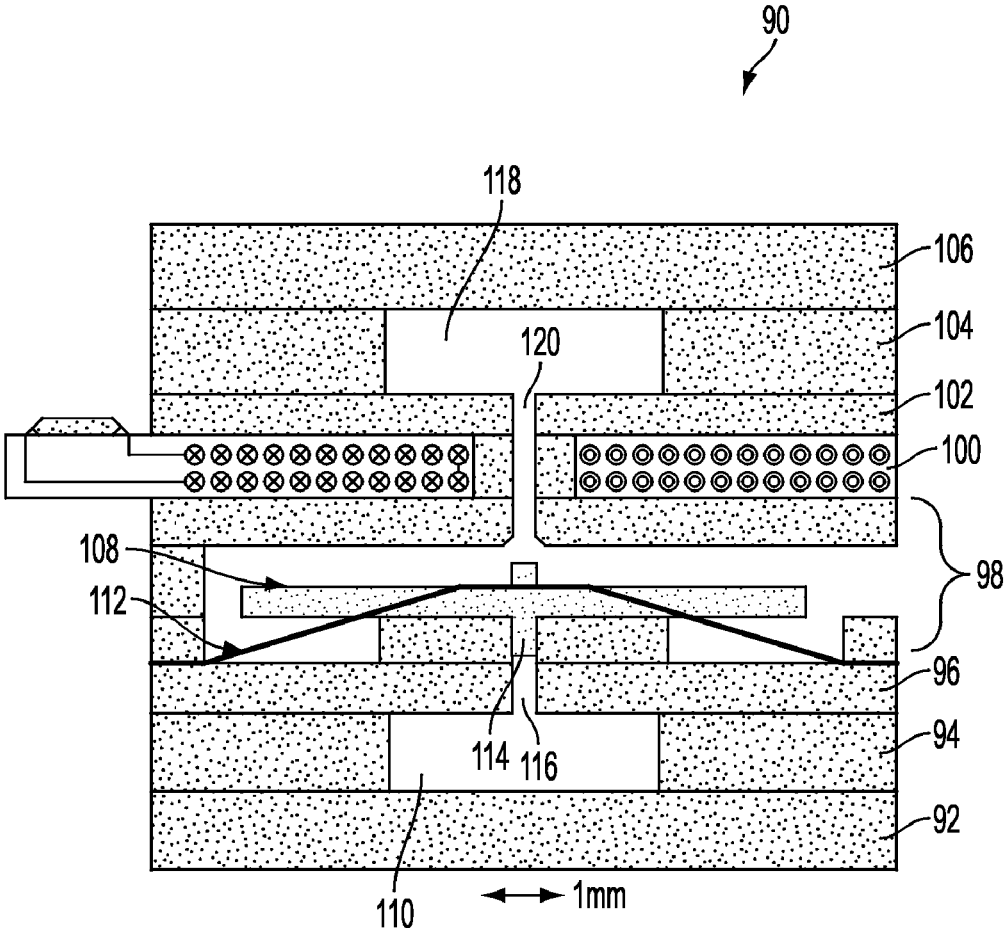
FIG. 5 is a cut-away view of a batch fabricated valve according to one aspect of the present invention.

FIG. 5 is an illustration of a batch fabricated valve 90 according to one aspect of the present invention. Valve 90 is formed as a laminated structure beginning with a substrate 92, a first supply channel structure 94, first spacer layer 96, a valve body 98, actuator coil and contact structure 100 (the number of windings indicated in the Figure is illustrative only, and is much smaller than would actually be present in this structure), second spacer layer 102, second supply channel structure 104 and top plate 106. Valve body 98 comprises a ferromagnetic flow control plate 108, biased against one side of the valve body, thereby preventing fluid flow into or out of first supply channel 110, by spring membrane 112. An index portion 114 of flow control plate 108 indexes into first fluid flow channel 116 to firmly seat the flow control plate 108 and ensure an effective seal against fluid entering or exiting first supply channel 110.

In the position illustrated in FIG. 5, fluid flowing in supply channel 118 is permitted to flow into second fluid flow channel 120, and thereby enter the valve body, which may be communicatively coupled to row or control (column) channels (not shown) running, for example, perpendicular to the face of the valve shown in FIG. 5. Valve 90 may be actuated to cause the fluid flow instead to flow from first supply channel 110 through first fluid flow channel 116 then into the valve body, while simultaneously shutting off the flow from second supply channel 118 by causing a current to flow in the coils of actuator coil and contact structure 100. This current indices a magnetic field which attracts the ferromagnetic flow control plate 108, and overcomes the bias of spring membrane 112.

In this design and variations thereon, the windings actually dominate the volume of the device. In those applications where this is not desirable, for example for size, weight, power consumption, or other reasons, many alternatives to the design exist. For example, the microfabricated elastomeric valve developed by Quake et al. at Cal Tech (M. A. Unger et al., Science, 288(7), 113-116 (2000), which is incorporated herein by reference), electrostatic or electro-kinetic pilot valves may also be employed.

During manufacture and servicing of the fluidic display device according to the present invention it is important to minimize the introduction of bubbles into the fluid circuit. The presence of bubbles in the pigmented fluid circuit will effect both the visual quality of the displayed image and the operation of the fluid control and distribution system 48. This is also true for a liquid crystal display. One method to fill the fluidic array is therefore quite similar. Initially, all air is pumped out of the display, either by placing the entire unit in a vacuum chamber, or by pumping out the manifolds. The aforementioned optional filling valves (not shown), situated on the periphery of the array, are connected a supply of pigmented fluid, and the fluid is introduced in a manner and at a rate such that the fluid then fills the manifolds without the introduction of bubbles. This process typically takes place during the construction of a new display device, but may also be performed in the servicing of a display device following the flushing out of any previously introduced pigmented fluid.

Furthermore, membranes 36*a*, 36*b* are preferably sufficiently deformable such that they can press out completely against either the top or bottom surface of the each pixel. Should bubbles enter into the row manifold, they can be removed from the pixels by pressurizing the control (column) manifold to collapse the membranes, thus squeezing the contents of fluid display regions 40*a*, 40*b* bubbles included, out into the row channels. The bubbles are then removed by draining the row manifold out through the service valves opposite the row address valves.

While a plurality of preferred exemplary embodiments have been presented in the foregoing detailed description, it should be understood that a vast number of variations exist, and these preferred exemplary embodiments are merely representative examples, and are not intended to limit the scope, applicability or configuration of the invention in any way. For example, row and column channels have been illustrated disposed generally on opposite sides of the cavity and fluid display region. However, the cavity and fluid display region may be laterally positioned relative to the channels. Indeed, through a design which includes various pixel channels, it is envisioned that the cavity and fluid display region may be located virtually anywhere proximate the source and drain for the pigmented fluid and the fluid control channel.

In addition, a two state display apparatus has been described above. However, a grayscale device may be provided by timing the amount of writing done to a pixel when it is activated for writing. The product of flowrate and time determines the amount of fluid displaced, and hence the optical density. An electronic controller produces the desired write times from calibration data generated at the time of assembly and testing.

Furthermore, while a monochrome display device has been described above, a color display device may be implemented by making stacked membrane, each membrane filled with pigmented fluid of a different color. An alternative is the use color filters, or lateral color. Thus, the foregoing detailed description provides those of ordinary skill in the art with a convenient guide for implementation of the invention, and contemplates that various changes in the functions and arrangements of the described embodiments may be made without departing from the spirit and scope of the invention defined by the claims thereto.

What is claimed is:

1. A pixel structure for a display device, comprising:

a substrate including a fluid inlet channel and a fluid outlet channel;

a top plate including a fluid control channel;

a pixel cavity proximate the intersections of said fluid inlet channel and said fluid control channel;

an impermeable membrane located in said pixel cavity defining a fluid display region between said membrane and said fluid inlet channel; and said substrate and top plate forming a sealed structure, said membrane unopenably isolating said fluid display region from said fluid control channel, and whereby a first state of the pixel structure may be established by the introduction of a pigmented fluid into said fluid display region from said fluid inlet channel and a second state of the pixel may be established by the evacuation of the pigmented fluid from said fluid display region into said fluid outlet channel.

2. The pixel structure of claim 1, further comprising a valve plate, disposed between said substrate and said top plate, having formed therein a first orifice positioned above said fluid inlet channel and a second orifice positioned above said fluid outlet channel such that the pigmented fluid may flow into said fluid display region through said first orifice, and further such that the pigmented fluid may flow out of said fluid display region through said second orifice.

3. The pixel structure of claim 2, further comprising a first valve located at said first orifice to selectively control the passage of fluid from said fluid inlet channel into said fluid display region.

4. The pixel structure of claim 3, further comprising a second valve located at said second orifice to selectively control the passage of fluid from said fluid display region into said fluid outlet channel.

5. A pixel structure for a display device, comprising:

a substrate including a fluid inlet channel and a fluid outlet channel;

a valve plate having formed therein a first orifice positioned above said fluid inlet channel and a second orifice positioned above said fluid outlet channel;

a pixel grid positioned above said valve plate so as to define a cavity;

an impermeable membrane located in said cavity defining a fluid display region between said membrane and said valve plate;

a first valve located at said first orifice to selectively control the passage of fluid from said fluid inlet channel into said fluid display region;

a second valve located at said second orifice to selectively control the passage of fluid from said fluid display region into said fluid outlet channel; and a top plate including a fluid control channel located above said pixel grid;

said substrate, valve plate, pixel grid, and top plate forming a sealed structure, said membrane unopenably isolating said fluid display region from said fluid control channel, and whereby a first state of the pixel may be established by the introduction of a pigmented fluid into said fluid display region under control of the first and second valves and a second state of the pixel may be established by the evacuation of the pigmented fluid from said fluid display region under control of the first and second valves.

6. The pixel structure of claim 5, wherein said first and second valves are operable in response to fluid pressure in said fluid inlet channel, said fluid outlet channel, and said fluid control channel, and wherein when fluids are introduced into said fluid inlet channel, said fluid outlet channel, and said fluid control channel, the pressures of said fluids may be adjusted to cause the first and second valves to permit the introduction of the pigmented fluid into said fluid display region, and further wherein the pressures of said fluids may be adjusted to cause the first and second valves to permit the evacuation of the pigmented fluid from said fluid display region.

7. The pixel structure of claim 5, wherein said fluid inlet channel has provided therein the pigmented fluid such that the pigmented fluid is permitted to flow from said fluid inlet channel, through said first valve, into said fluid display region to establish said first state.

8. The pixel structure of claim 7, wherein said pigmented fluid is an aqueous ink.

9. The pixel structure of claim 7, wherein said pigmented fluid is a pigmented oil.

10. The pixel structure of claim 5, wherein said membrane is at least partially optically transparent.

11. The pixel structure of claim 5, wherein said top plate is at least partially optically transparent.

12. The pixel structure of claim 11, wherein said fluid control channel has provided therein an optically transparent fluid such that the introduction into and evacuation from the fluid display region of the pigmented fluid is controlled at least partially by the pressure of said transparent fluid in said fluid control channel.

13. The pixel structure of claim 12, wherein said valve plate has a surface color such that when the pigmented fluid is evacuated from said fluid display region the colored surface plate is visible through said membrane in order to establish said second state of the pixel.

14. A display device, comprising:

a substrate including a plurality of fluid inlet channels and a fluid outlet channels;

a valve plate having formed therein a plurality of first orifices positioned above said fluid inlet channels and a plurality of second orifices positioned above said fluid outlet channels;

a pixel grid positioned above said valve plate, said pixel grid defining a plurality of individual pixels, each pixel comprising:

a cavity defined by said pixel grid;

a first orifice positioned above one of said fluid inlet channels and a second orifice positioned above one of said fluid outlet channels adjacent said one of said fluid inlet channels;

an impermeable membrane located in said cavity defining a fluid display region between said membrane and said valve plate;

a first valve located at said first orifice to selectively control the passage of fluid from said fluid inlet channel into said fluid display region;

a second valve located at said second orifice to selectively control the passage of fluid from said fluid display region into said fluid outlet channel; and a transparent top plate located above said pixel grid, said transparent top plate including a plurality of fluid control channels extending generally perpendicularly to said plurality of fluid inlet channels and a fluid outlet channels;

said substrate, valve plate, pixel grid, and top plate forming a sealed structure;

an inlet/outlet fluid manifold connected to the sealed structure, comprising:

a fluid pump;

pressure regulators communicatively coupled to said fluid pump; and a valve array communicatively coupled to said pressure regulators and said inlet fluid channels and said outlet fluid channels such that the fluid pressure of fluid disposed in each inlet channel and each outlet channel may be independently controlled;

a fluid control manifold connected to the sealed structure, comprising:

a fluid pump;

pressure regulators communicatively coupled to said fluid pump; and a valve array communicatively coupled to said pressure regulators and said fluid control channels such that the fluid pressure of fluid disposed in each said fluid control channel may be independently controlled; and whereby for each pixel, said membrane isolates said fluid display regions from said fluid control channels, and further whereby a first state of an individual pixel may be established by the introduction of a pigmented fluid into said fluid display region of that pixel under control of the first and second valves of that pixel, and a second state of that individual pixel may be established by the evacuation of the pigmented fluid from said fluid display region of that pixel under control of the first and second valves of that pixel.

15. The display device of claim 14, wherein said inlet/outlet fluid manifold comprises three pressure regulators, a first pressure regulator providing a relatively high pressure, a second pressure regulator providing a relatively low pressure, and a third pressure regulator providing a pressure between said relatively high pressure and said relatively low pressure.

16. The display device of claim 14, further comprising a fill and drain port for filling the device with pigmented fluid and for removing the pigmented fluid from the device as part of servicing the device.

17. The display device of claim 14, wherein the valve arrays of the inlet/outlet fluid manifold and the fluid control manifold comprise valves which are magnetically activated.

18. A method of selecting between display states of a pixel, comprising:

selecting a first state by introducing a pigmented fluid into a display region of the pixel from an inlet channel by controlling the balance of pressures between said inlet channel, an outlet channel, and a control channel, such that said inlet channel and said outlet channel are isolated from said control channel, the pigmented fluid visible through a transparent top plate in the pixel such that the pixel appears to be the color of the pigmented fluid; and selecting a second state by evacuating the pigmented fluid from the display region of the pixel through the outlet channel by controlling the balance of pressures between said inlet channel, said outlet channel, and said control channel, such that said inlet channel and said outlet channel remain isolated from said control channel, an interior portion of the pixel thereby being made visible through the transparent top plate in the pixel such that the pixel appears to be the color of the interior portion of the pixel.

19. The method of claim 18, wherein the balance of pressures between said inlet channel, said outlet channel, and said control channel cause the opening of a passive valve between said inlet channel and said fluid display region to permit the introduction of the pigmented fluid into the fluid display region.

20. The method of claim 19, wherein the balance of pressures between said inlet channel, said outlet channel, and said control channel cause the opening of a passive valve between said fluid display region and said outlet channel to permit the evacuation of the pigmented fluid from the fluid display region.

21. The method of claim 19, further comprising the step of:

selecting a third state by partially evacuating the pigmented fluid from the display region of the pixel through the outlet channel by controlling the balance of pressures between said inlet channel, said outlet channel, and said control channel, such that the pixel appears to be a blend of the color of the pigmented fluid and the color of the interior portion of the pixel.

* * * * *